United States Patent [19]

Fischer

[11] 4,436,607

[45] Mar. 13, 1984

[54] ANODE SUPERSTRUCTURE OF A FUSED SALT ELECTROLYTIC CELL AND POT ROOM FITTED OUT WITH SAME

[75] Inventor: Werner K. Fischer, Venthône, Switzerland

[73] Assignee: Swiss Aluminium Ltd., Chippis, Switzerland

[21] Appl. No.: 394,115

[22] Filed: Jul. 1, 1982

[30] Foreign Application Priority Data

Jul. 14, 1981 [CH] Switzerland ..... 4598/81

[51] Int. Cl.[3] ..... C25C 3/10; C25C 3/22

[52] U.S. Cl. ..... 204/246; 204/247; 204/279

[58] Field of Search ..... 204/243 R–247, 204/67, 279, 286

[56] References Cited

U.S. PATENT DOCUMENTS 2,861,036 11/1958 Simon-Suisse ..... 204/243 R
3,575,827 4/1971 Johnson ..... 204/247 X
3,607,685 9/1971 Johnson ..... 204/244 X
4,043,892 8/1977 Gonzalez et al. ..... 204/247
4,087,345 5/1978 Sandvik et al. ..... 204/243 R

*Primary Examiner*—Donald R. Valentine
*Attorney, Agent, or Firm*—Bachman and LaPointe

[57] ABSTRACT

Conventional fused salt reduction cells feature anode conductor sections which are spaced apart and have the function of feeding electric current to the anodes via anode rods. An electrically insulated footbridge positioned over the cell between the anode conductor sections makes it possible to walk above the cell. A housing with slight positive pressure created by the supply of fresh air to it, is preferably provided over this footbridge. Transverse cells are arranged asymmetrically in a pot room. An air-tight, closeable walk-way i.e. gangway is provided on the inside or outside of the long wall of the pot room. Extensions to the cell housings lead to appropriate openings in the long wall of the pot room or to the longitudinal wall of a gangway in the interior of the pot room. The fresh air is passed through the gangway and emerges from the open end of the cell housing.

11 Claims, 2 Drawing Figures

ANODE SUPERSTRUCTURE OF A FUSED SALT ELECTROLYTIC CELL AND POT ROOM FITTED OUT WITH SAME

BACKGROUND OF THE INVENTION

The invention relates to the anode superstructure of a fused salt electrolytic cell for producing aluminum, with anode conductor sections which are spaced apart and feed electric current to anode rods supporting the anodes, and also relates to a pot room fitted with the same.

In order to produce aluminum by the fused salt electrolysis of aluminum oxide, the latter is dissolved in a fluoride melt comprised for the main part of the cryolite. The cathodically precipitated aluminum collects under the fluoride melt on the carbon floor of the cell, the surface of the liquid aluminum itself forming the cathode. Dipping into the melt from above are anodes which is conventional processes are made of amorphous carbon. Oxygen is formed at the carbon anode as a result of the electrolytic decomposition of the aluminum oxide; this oxygen combines with the carbon of the anodes to form $CO_2$ and CO. The electrolytic process takes place in a temperature range of about 940°-970° C.

In the course of the electrolytic process the electrolyte becomes depleted in aluminum oxide. At a lower concentration of 1 to 2 wt.% aluminum oxide in the electrolyte the anode effect occurs whereby the voltage rises from e.g. 4-5 V to 30 V and more. Then at the latest the crust of solid electrolyte must be broken open and the aluminum oxide concentration raised by adding fresh alumina.

The efficiency and thereby the area covered by modern aluminum reduction cells is always being increased. The applied currents exceed 200 kA and can be as much as 300 kA. The anodic part of the cell is becoming more complicated, as is to be expected with more efficient, larger cells with fully automatic control. In recent times therefore the supply of alumina to the cell has been increasingly made using at least two point feeder units each of which features a silo and a measured feed and crust breaker facility. Another trend is no longer to raise or lower all the anodes together but to do this individually.

Working on the anode superstructure above the hooding to carry out inspection and repair these presents health and safety problems.

It is therefore an object of the invention to develop a means of easy access to all essential positions on the anode superstructure, which enables safe and hygienically acceptable working conditions for carrying out the necessary inspection and small repair work on modern molten salt reduction cells used to produce aluminum.

SUMMARY OF THE INVENTION

The object is achieved by way of the invention in that there is provided an electrically insulated footbridge, which can be mounted from at least one end of the cell and is situated between the anode conductor sections over the whole length of the cell.

In the simplest case a suitable sheet for walking on, and which serves simultaneously as footbridge and component part of the cell covering, is positioned between the usually 1-2 m apart anode conductor sections which are usually rectangular in cross section. Strengthening sections are provided, therefore, especially when the distance between the anode conductor sections are larger. Further, the surface of the footbridge is preferably thermally insulated in order that employees may walk on that part of the cell with normal industrial footwear. In order that the central part of the cell can be observed, closeable openings are provided on the footbridge.

Usefully, the footbridge is arranged such that the two anode conductor sections serve as a protective railing.

BRIEF DESCRIPTION OF THE DRAWINGS

The invention is explained in greater detail in the following description of exemplified embodiments and with the help of the schematic, perspective drawings viz.

DETAILED DESCRIPTION

Figure 1:
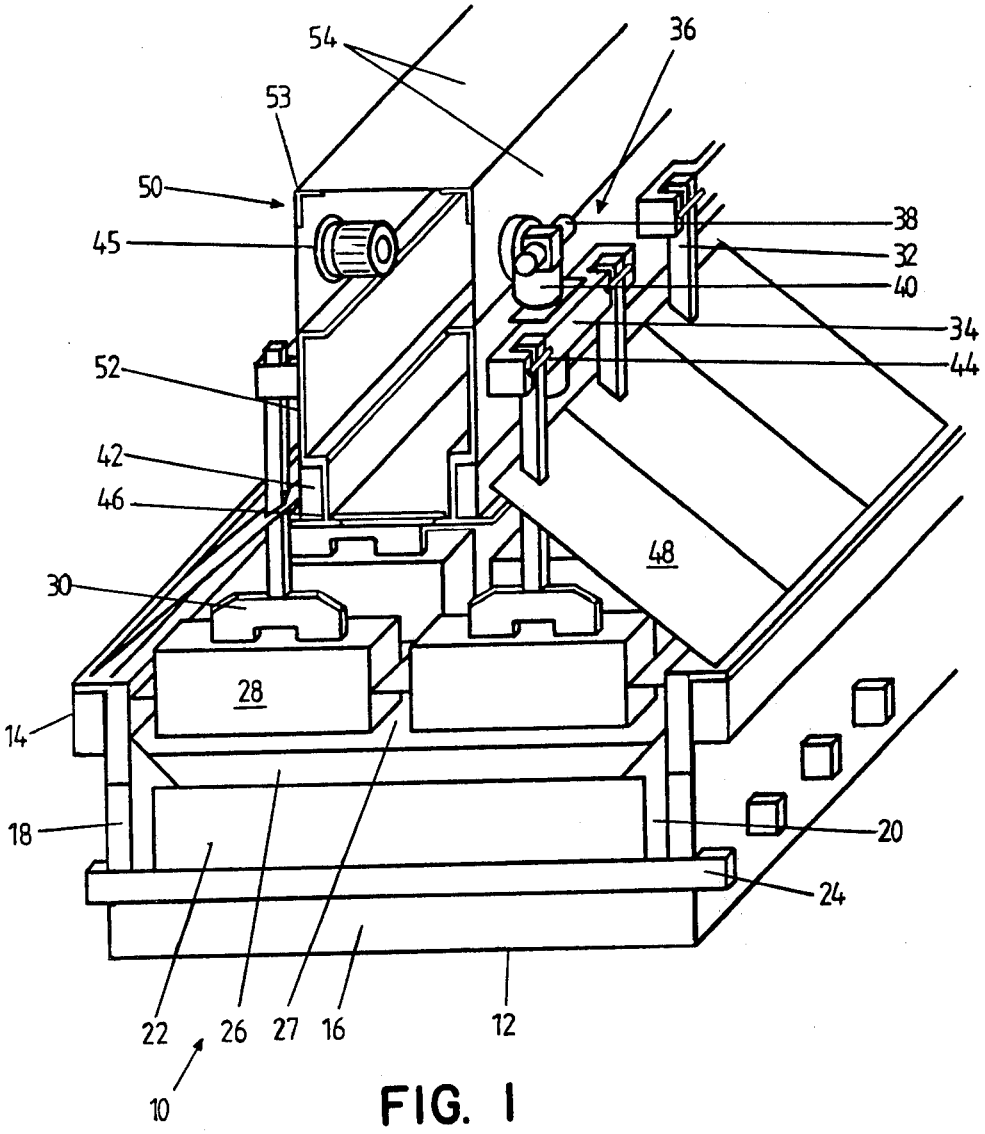
FIG. 1: A fused salt electrolytic cell for producing aluminum, open at the ends.

A preferred version is such that a housing at least the height of a man is provided above the footbridge; this housing can be tightly sealed at the bottom and can be ventilated. The alumina and flux feed pipes and the waste gas exhaust pipe are preferably situated in this housing which, like the footbridge, extends the whole length of the cell. If a crust breaker facility is mounted in the region of the longitudinal axis of the cell, it likewise passes through the housing.

If all important functional parts of the anode superstructure are not arranged to be accessable inside the housing, closeable exits can be provided at suitable points.

Entry to the housing is gained at one end. A suitable ventilation duct ensures there is always a slight positive pressure in the housing. The employee can therefore carry out his work of supervision and repair in an absolutely uncontaminated atmosphere. A small positive pressure of usefully $\leqq 1$ mm water column, produced by the supply of fresh air, ensures as adequate number of air changes per hour. The fresh air flowing through housing also makes it possible, at the same time, to cool the electrical conductors to the anodes, which is an advantage in terms of conductivity.

The upper part of the housing can be of a transparent material, for example plexiglass. This enables many tasks to be carried out in natural daylight, and allows the outer parts of the electrolytic cell and their surroundings to be observed.

Before installing the footbridge, the anodic conductor sections are fitted with an insulating material, in order to prevent the footbridge or possibly the whole housing from having the electrical potential of the anodes. For safety reasons, the part of the footbridge over the vertical projection of the cell can be made of electrically insulating material.

According to the invention a hall with an asymmetrically arranged row of transverse electrolytic cells for producing aluminum, and having an accessable housing with a floor featuring at least in part, closeable openings, is characterized by way of a releasable extension of the housing reaching to the adjacent longitudinal pot room wall, an opening in the longitudinal pot room wall for each housing and corresponding in cross-section to the inner cross section of the said housing, and an air-tight gangway with fresh air supply, arranged at the level of the openings and extending the whole length of the inner or outer pot room wall adjacent to the row of cells.

The adjacent longitudinal pot room wall is normally 1-2 m from the end of the cells. The gangway which runs the full length of the wall can be situated inside or outside of the pot room. In the case of the former the openings are in the longitudinal wall of the gangway, in the latter case in the pot room wall. The extension of the housing to the gangway running the full length of the pot room permits the worker to carry out a plurality of control and operating tasks without having to inhale the pot room atmosphere. By means of steps he gains access to the gangway and from there can move onto the cells in a protective atmosphere.

In order to permit a certain flexibility between the cell and the longitudinal wall a releasable bellows or concertina arrangement of synthetic material can be provided, or the extension of the cell housing can be extended telescopically into one of the fitments surrounding one of the openings in the pot room wall.

Referring to FIG. 1, the cathodic part of cell 10 for fused salt electrolytic production of aluminum comprises a steel tank 12 with reinforcing section 14 at the edge of the cell. The lower part of the steel tank 12 is covered with an insulating layer 16, the sidewall region with blocks 18. The cathode blocks 22 which contain the cathode bars 24 are anchored into the cell by means of a ramming mass 20 consisting mainly of carbon.

Dipping into the bath which is made up of liquid aluminum 26 at the bottom and electrolyte 27 at the top, are carbon anodes 28 which are suspended on anode rods 32 via studs 30.

In the present example the level of the anodes is adjusted pairwise; each pair of anode rods 32 is releasably attached to an anode beam 34. These beams 34 can be displaced in the vertical direction by means of a jacking system 36 comprising essentially a step-down gearing facility 38 which operates on a spindle, not visible here, in a spindle housing 40.

Instead of the double anode drive illustrated here an anode beam which extends the whole length of the cell can be employed; such as anode beam raises or lowers all the anode rods 32 as one. Alternatively the anodes can be fitted individually with such jacking facilities. The electric current is supplied via rigid anode conductor sections 42 from which flexible conductor straps, not shown here, lead the current to the anode beams 34. When anode changes are made, both anodes 28 suspended on an anode beam 34 are changed simultaneously by opening the locking fixtures 44. By putting the motor drive 45 into action, the anode beam 34 is raised until the new anodes can be set at the correct level.

Positioned between the anode conductor sections 42 is a footbridge 46 which is made of steel sheet and which also forms the central part of the hooding over the cell. The side region of the cell is closed off by means of lids 48 which can be raised.

A housing 50 which offers protection from the atmosphere of the pot room is arranged over the footbridge. The lower part of the housing 50 comprises at least two longitudinal girders 52, the upper part 54 of plexiglass sheets supported by two angle sections 53.

In smaller reduction cells the anode conductor sections 42 can at the same time be the load-bearing part of the anode superstructure. In larger cells this load-bearing function is taken over by longitudinal girders. For reasons of clarity the feed pipes for alumina and flux, the pipes of the pneumatic system, the electric cables and the conduit for waste gas extraction, all of which are in the housing 50, are omitted here.

Figure 2:
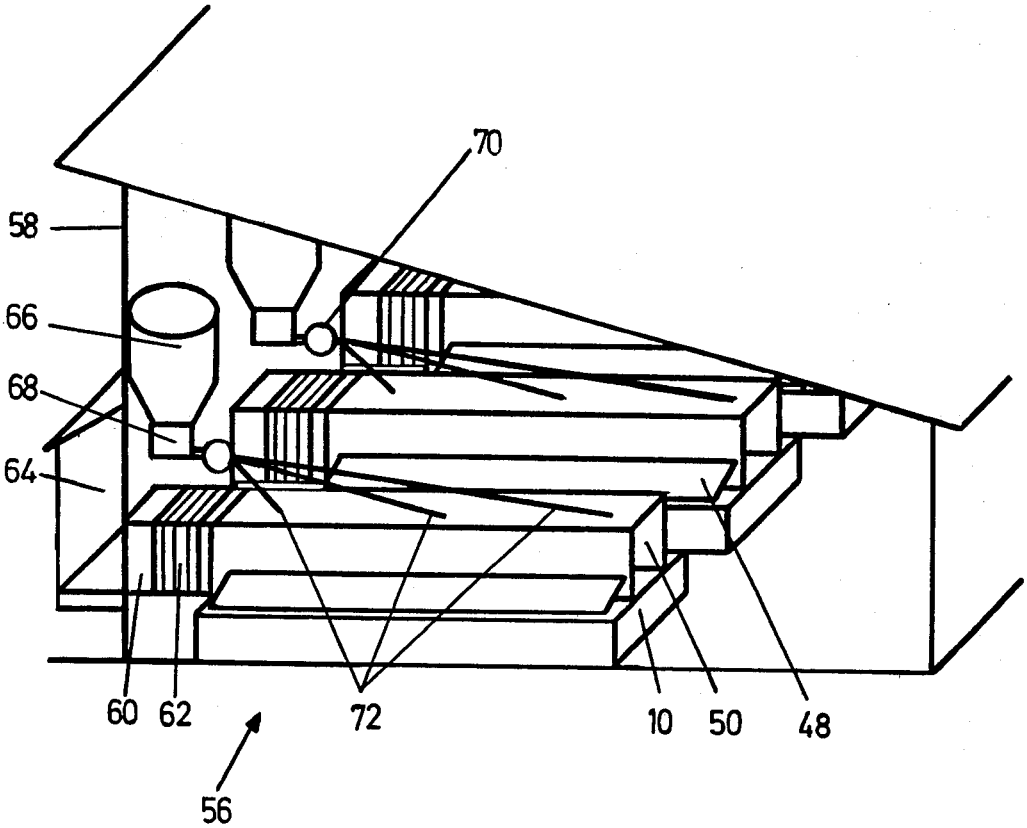
FIG. 2: A pot room with a row of asymmetric electrolytic cells.

The pot room 56 shown in FIG. 2 features transversely arranged electrolytic cells 10 in an asymmetric arrangement. The cell housings 50 are extended in the direction of the pot room wall 58, which is a distance of 1-1.5 m from the pots, and lead to openings in the wall 58 of the same cross-sectional dimension as the housings 50. A projecting fitment 60 mounted at the opening on the inside of the pot room is releasably attached, via a bellows-like arrangement 62 of synthetic, elastic material, to the cell housing 50 which is open at that end of the cell. The housing 50 is open at the opposite end. A gangway 64 which runs the whole length of the pot room is provided on the outside of the pot room wall 58. The floor of this gangway 64 is at the same level as the openings in the wall 58 leading to the housings 50. Fresh air blowers link up to this gangway 64 and produce a slight positive pressure in the housings 50. The fresh air escapes through the open ends, thus preventing pot room atmosphere from entering the housings 50.

Each cell is fitted with a day's supply silo 66 which in the present case is situated inside the pot room. A controlled feed device 68 of a known kind operating gravimetrically or volumetrically can supply the cell 10 with the necessary alumina and flux. The cell 10 is fed at three points; a distributor 70 of a conventional kind ensures uniform supply of all three point feeders via distributor pipes 72.

According to further versions, not shown here:

The day's supply silos 66 can be situated inside, the controlled feed facilities 68 and distributors 70 outside, or the day's supply silos 66, the controlled feed facilities 68 and the distributors 70 outside.

It should be possible to operate the controlled feed facilities 68 and the distributors 70 from the gangway 64 which is preferably accessable from the pot room interior.

What is claimed is:

1. Anode superstructure of a hooded fused salt electrolytic cell for producing aluminum which comprises anodes in said cell, spaced apart anode conductor sections communicating with said anodes and feeding electric current to said anodes, and an electrically insulated footbridge positioned between said anode conductor sections over the length of the cell accessible at least from one end of said cell wherein a housing which is open at least one end is provided over the footbridge.

2. Superstructure according to claim 1 wherein the upper part of the housing is made of a transparent material.

3. Superstructure according to claim 1 including at least one asymmetric row of transverse cells arranged in a pot room.

4. Superstructure according to claim 3 wherein said anodes are supported by anode rods.

5. Superstructure according to claim 4 wherein said pot room includes a longitudinal pot room wall and wherein said housing includes a releasable extension reaching to said longitudinal wall.

6. Superstructure according to claim 5 including an opening in said longitudinal wall for said housing corresponding in cross section to the inner cross section of said housing.

7. Superstructure according to claim 6 including an air-tight gangway arranged at the level of said opening and running the length of the pot room wall adjacent said cells.

8. Superstructure according to claim 7 including a 1–2 m wide space between the housing and said longitudinal wall bridged by a fitment which frames said opening and an elastic bellows-like arrangement which can be pushed into the wall fitment.

9. Superstructure according to claim 8 wherein said bellows-like arrangement is a telescopic extension of the housing.

10. Superstructure according to claim 8 wherein the bellows includes electrical insulation between the housing and the wall fitment.

11. Superstructure according to claim 7 wherein the gangway is accessible from the interior of the pot room.

* * * * *